United States Patent [19]

Ewbank

[11] Patent Number: 4,756,264

[45] Date of Patent: Jul. 12, 1988

[54] NOISE DAMPING SYSTEM FOR TORPEDOES OR THE LIKE

[75] Inventor: Michael E. Ewbank, Rockford, Ill.

[73] Assignee: Sundstrand Corporation, Rockford, Ill.

[21] Appl. No.: 944,966

[22] Filed: Dec. 22, 1986

[51] Int. Cl.[4] ..... B63H 21/08; E42B 19/00; F01K 9/00

[52] U.S. Cl. ..... 114/20.1; 60/668; 114/20.2

[58] Field of Search ..... 114/20.2, 20.1; 60/668

[56] References Cited

U.S. PATENT DOCUMENTS

| | | | |
|---|---|---|---|
| 3,001,498 | 9/1961 | Karp | 114/20.1 |
| 3,109,401 | 11/1963 | Karig | 114/20.2 |
| 3,130,700 | 4/1964 | Peterson | 114/20.1 |
| 3,327,669 | 6/1967 | Olson | 114/20.1 |
| 3,382,832 | 5/1968 | Swanson | 114/20.1 |
| 3,838,658 | 10/1974 | Faeth | 114/20.1 |
| 3,964,416 | 6/1976 | Kiraly et al. | 114/20.2 |
| 4,395,965 | 8/1983 | Lang | 114/20.1 |
| 4,637,213 | 1/1987 | Lobell et al. | 114/20.2 |

*Primary Examiner*—David H. Brown

*Attorney, Agent, or Firm*—Wood, Dalton, Phillips, Mason & Rowe

[57] ABSTRACT

A noise damping system incorporating in the hull of an underwater torpedo or the like which includes a power plant having a boiler. An inner hull section includes hotwell passages about the boiler whereby subcooled liquid in the hotwell passages absorbs heat from the boiler. A noise damping elastomer layer is provided about the inner hull section whereby the hotwell passages insulate the noise damping layer from the boiler. An outer hull section has condenser passages about the noise damping layer. The hotwell passages and the condenser passages are part of the closed circulation system of the power plant.

20 Claims, 1 Drawing Sheet

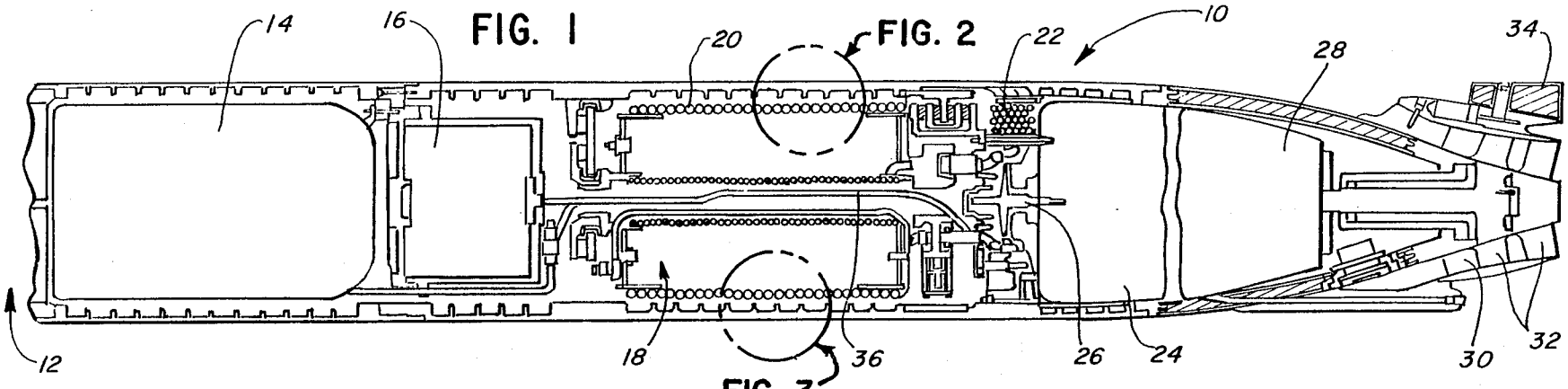
FIG. 1
FIG. 2
FIG. 3
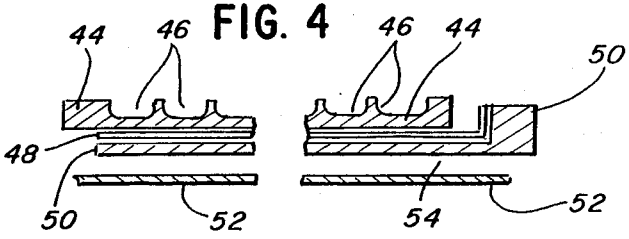
FIG. 4
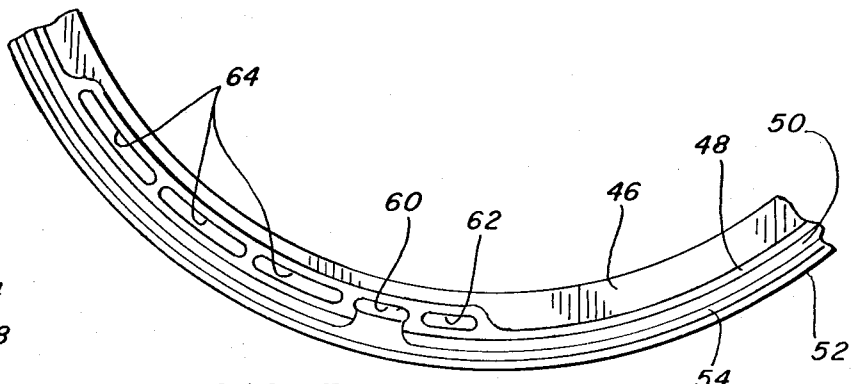
FIG. 5
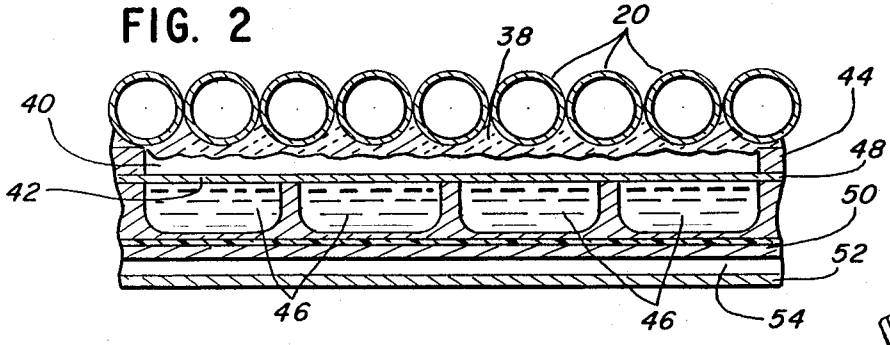
FIG. 2
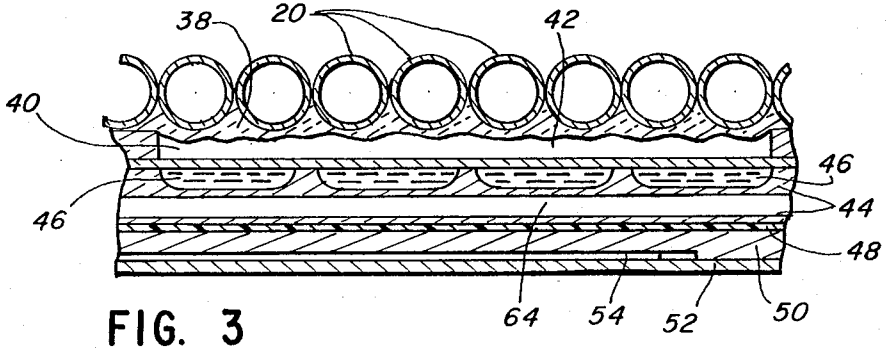
FIG. 3

NOISE DAMPING SYSTEM FOR TORPEDOES OR THE LIKE

Field of the Invention

This invention generally relates to a noise dampening system for use in underwater torpedos, or the like, and particularly to a noise damping system incorporated directly into the torpedo hull.

Background of the Invention

Underwater vehicles, such as torpedoes or the like, conventionally include a power plant having a boiler for heating liquid, such as water. The boiler includes tubes which change the water into superheated steam for supply to an engine which propels the torpedo. The engine extracts mechanical energy from the steam which then flows into a condenser section of the torpedo. Often, the condenser section comprises passages about the torpedo hull whereby seawater cools the steam in the condenser passages and transforms the steam back into liquid, i.e. water. The subcooled water then enters a hotwell where the water is stored until being pumped back to the boiler and its tubes.

One of the problems with torpedoes is the noise or vibrations which radiate into the surrounding seawater which, in turn, can reveal the presence of the torpedo. One of the major sources of noise transmission is in and around the boiler of the torpedo where water is boiled and converted into steam in a large number of tubes. The sheer mass of this section of the torpedo hull surrounding the boiler itself is a major noise transmitting area or noise "sounding board" of the vehicle.

A convenient means of damping noise vibrations is the use of elastomeric materials for absorbing the noise vibrations. However, the use of such materials surrounding the boiler section of the torpedo creates problems because of the heat emanating outwardly from the boiler through the surrounding torpedo hull. Many elastomeric compounds could be used and most such compounds include hydrocarbons. However, such hydrocarbons have temperature limitations and will break down at temperatures on the order of 300 degrees F. On the other hand, the boiler runs approximately 2,000 degrees F., with the generated steam being on the order of 1,600 degrees F. It immediately can be seen that mere insulation, air gaps or other static means would be insufficient to isolate any noise damping elastomers unless the insulation was so thick as to be totally impractical.

This invention is directed to solving the above problems by providing a noise damping system incorporated directly into the hull portion surrounding the torpedo boiler or the like and which is insulated by the components of the power plant itself.

Summary of the Invention

An object, therefore, of the invention is to provide a novel noise damping system for use in an underwater torpedo, or the like, which includes a power plant having a boiler surrounded by portion of the torpedo hull, the noise damping system being incorporated in the hull portion.

Generally, the invention contemplates sandwiching a noise damping means, such as an elastomeric noise dampener, between an inner hull section having a hotwell means and an outer hull section surrounding the power plant or boiler whereby the hotwell means not only insulates the noise damping means from the boiler but carries away heat from the boiler in a continuous process.

In the exemplary embodiment of the invention, the inner hull section includes hotwell means about the boiler whereby subcooled water in the hotwell absorbs heat from the boiler and carries the heat therefrom. Noise damping means, such as a layer of elastomeric material, is disposed about the inner hull section whereby the hotwell means insulates the noise damping means from the boiler. An outer hull section is disposed about the noise damping means. The outer hull section may comprise the condenser means of the power plant.

As disclosed herein, the hotwell means inside the noise damping means comprises a plurality of passages extending circumferentially about the boiler within the inner hull section. The condenser means comprises a plurality of passages in the outer hull section. Passage means connect the condenser passages with the hotwell passages for delivering the condensed, subcooled water from the condenser to the hotwell where the water ultimately is channeled back to the boiler.

Therefore, a closed system is provided wherein the subcooled water acts as a kinetic insulating means to isolate the noise damping means from the heat of the boiler.

Other objects, features and advantages of the invention will be apparent from the following detailed description taken in connection with the accompanying drawings.

Description of the Drawings

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a longitudinal section through a portion of a torpedo, illustrating the major components of the power plant thereof;

FIG. 2 is an inverted, fragmented, longitudinal section, on an enlarged scale, taken in proximity of the circled area designated in FIG. 1;

FIG. 3 is a fragmented, longitudinal section, on an enlarged scale, taken in proximity of the circled area designated in FIG. 1;

FIG. 4 is an exploded longitudinal section illustrating somewhat schematically the structural hull components; and FIG. 5 is a fragmented radial section through a portion of the hull construction.

Detailed Description of the Preferred Embodiment

Referring to the drawings in greater detail, and first to FIG. 1, a longitudinal section through a torpedo, generally designated 10, is shown to illustrate the major components and locations thereof within the torpedo in order to set forth the environment of the invention. Specifically, an explosive head (not shown) is located forwardly of the torpedo, generally in the area designated 12. Located behind the explosive head are various components which include an oxidant tank 14, a command wire reel 16, a boiler section generally designated 18 and including a plurality of circumferentially extending boiler tubes 20, a regeneration section 22, a drive section 24 including a turbine 26, a transmission section 28 and a propulsion section 30. As is known, the power plant described above is effective to rotate propeller blades 32 for propelling the torpedo through the water. A remote or sensor controlled fin 34 is provided at the rear, outside of the torpedo, for directing the torpedo through the water.

Generally, water flows through boiler tubes 20 of boiler 18 which changes the water into superheated steam. The superheated steam is directed, as at 36, to the turbine which extracts mechanical energy from the steam. The steam then flows into condenser passages (described hereinafter) surrounding boiler 18. The seawater cools the steam in the condenser passages, transforming the steam back to water. This subcooled water then enters hotwell passages, described hereinafter, where it is stored until being pumped into boiler 18. As will be seen hereinafter, the invention utilizes this very recirculation concept of conventional boilerrun torpedoes as the means for cooling the noise damping system of the invention.

More particularly, FIGS. 2 and 3 show in detail the noise damping system of the invention which is incorporated in the hull portion surrounding boiler 18. Boiler tubes 20 are shown in each figure. Some static insulation 38 and an air gap 40 are disposed about the hull surrounding boiler tubes 20. The air gap is defined by a cylindrical shell 42.

Referring specifically to FIGS. 2 and 3, an inner hull rib section 44 surrounds shell 42 and defines a plurality of circumferential hotwell passages 46 surrounding shell 42. A noise damping layer 48 of elastomeric material surrounds inner hull rib section 44. An inner hull condenser section 50 surrounds elastomer layer 48 and sandwiches the layer between the inner hull rib section 44 and the inner hull condenser section 50. An outer hull section or shell 52 surrounds inner hull condenser section 50 and defines condenser passages 54 extending longitudinally of the hull.

FIG. 4 shows somewhat schematically the basic components described above in relation to FIGS. 2 and 3 for assembling the noise damping system described. Noise damping elastomer layer 48 first is bonded to the outside of inner hull rib section 44 which defines hotwell passages 46. An adhesive then is applied to the inside of inner hull condenser section 50 which then is applied to the inner hull rib section 44 to sandwich elastomer layer 48 therebetween. In assembly, outer hull 42 then is slid over this composite and the boiler itself placed within the hull assembly.

During operation, water flows through boiler tubes 20 wherein the water is changed into superheated steam. The superheated steam is channeled to the turbine, as at 36 (FIG. 1), where the turbine or other engine of the torpedo extracts mechanical energy from the steam. The steam then flows back through condenser passages 54 which surround the boiler and during which the outside seawater cools the steam in the condenser passages to transform the steam back into water. The subcooled water then is channeled into hotwell passages 46 where it is stored in a flowing action as it is being pumped back to the boiler tubes. A recirculation pump (not shown) is provided in the system for the above described circulation of the steam and water.

FIG. 5 shows a cross-sectional portion of the hull construction and it can be seen that passages 60 are provided for channeling subcooled water from condenser passages 54 to hotwell passages 46, and a passageway 62 is provided for channeling the water from the hotwell passages back to the pump. Additional passages 64 may be provided at various angular locations extending longitudinally of the hull section, as desired, to accommodate electrical cables or the like without interfering with the recirculation system.

FIG. 3 is a view similar to that of FIG. 2, but taken at the bottom of the torpedo in the area designated in FIG. 1. It can be seen that hotwell passages 46 are made somewhat smaller in inner hull rib section 44, and condenser passages 54 are made somewhat smaller between inner hull condenser section 50 and outer hull section 52, in order to form the passages 64 for accommodating the electrical cables or the like described in relation to FIG. 5. Of course, it is only in this limited area that hotwell passages 46 and condenser passages 54 are of reduced dimensions and do not inhibit the insulation of noise damping elastomer layer 48 in view of the fact that liquid and steam continuously flow through the passages.

From the foregoing, it can be seen that a unique system has been provided wherein the very components of the power plant system, such as the hotwell means and the condenser means, are utilized as the insulating means for noise dampening means 48. Regardless of how sophisticated a static insulation system may be, such a system still faces the problem of confronting extremely high temperatures radiating from the interior boiler. With the system of this invention, the insulating means for elastomer layer 48 constantly is a kinetic system which constantly carries away heat in the normal closed system of the power plant. In addition, it should be noted that there is no heat loss in this system because of the rearrangement of the components. Heat from the boiler which is absorbed by the insulating hotwell means simply goes back into the system.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an underwater torpedo or the like which includes a power plant having a boiler surrounded by a portion of the torpedo hull, a noise damping system incorporated in said hull portion, comprising:

an inner hull section including hotwell means independent of and about the boiler whereby subcooled liquid in the hotwell means absorbs heat from the boiler;

noise damping means about the inner hull section whereby the hotwell means insulates the noise damping means from the boiler; and an outer hull section about the noise damping means.

2. The noise damping system of claim 1 wherein said noise damping means are fabricated of elastomeric material.

3. The noise damping system of claim 1 wherein said inner hull section includes a plurality of passages defining said hotwell means.

4. The noise damping system of claim 3 wherein said passages extend circumferentially about the boiler within the inner hull section.

5. The noise damping system of claim 1 wherein said noise damping means comprises a layer of material surrounding the hotwell means.

6. The noise damping system of claim 5 wherein said layer is fabricated of elastomeric material.

7. The noise damping system of claim 1 wherein said outer hull section includes condenser means for cooling steam from the torpedo power plant.

8. The noise damping system of claim 7 wherein said condenser means comprise a plurality of passages in the outer hull section.

9. The noise damping system of claim 7, including means communicating between the condenser means and the hotwell means for delivering the condensed, subcooled water from the condenser means to the hotwell means.

10. In an underwater torpedo or the like which includes a power plant having a boiler surrounded by a portion of the torpedo hull, a noise damping system incorporated in said hull portion, comprising:

an inner hull section including a plurality of passages defining a hotwell independent of and about the boiler whereby subcooled liquid in the hotwell passages absorbs heat from the boiler;

an elastomeric noise damping means about the inner hull section whereby the hotwell passages insulates the elastomeric means from the boiler; and an outer hull section including condenser means for cooling steam from the torpedo power plant.

11. The noise damping system of claim 10 wherein said hotwell passages extend circumferentially about the boiler within the inner hull section.

12. The noise damping system of claim 10 wherein said elastomeric noise damping means layer is sandwiched between the inner and outer hull sections.

13. The noise damping system of claim 10 wherein said condenser means comprise a plurality of passages in the outer hull section.

14. The noise damping system of claim 10, including means communicating between the condenser means and the hotwell passages for delivering the condensed, subcooled water from the condenser means to the hotwell passages.

15. In an underwater torpedo or the like which includes a power plant having a boiler, a noise damping system comprising:

hotwell means independent of and about the boiler whereby subcooled liquid in the hotwell absorbs heat from the boiler; and noise damping means about the hotwell means whereby the hotwell means insulates the noise damping means from the boiler.

16. The noise damping system of claim 15 wherein said hotwell means comprise a plurality of passages extending circumferentially about the boiler.

17. The noise damping means of claim 15, including condenser means about said noise damping means.

18. The noise damping means of claim 17, including means communicating between the condenser means and the hotwell means for delivering the condensed, subcooled water from the condenser means to the hotwell means.

19. The noise damping means of claim 15 wherein said noise damping means comprises a layer of material surrounding the hotwell means.

20. The noise damping system of claim 19 wherein said layer is fabricated of elastomeric material.

* * * * *